US006390648B1

(12) United States Patent
Privas et al.

(10) Patent No.: US 6,390,648 B1
(45) Date of Patent: May 21, 2002

(54) DISPLAY APPARATUS FOR WORKS OF ART

(76) Inventors: Yves E. Privas; Tanguy M. Privas, both of 24 Seneca Rd., Sea Ranch Lakes, FL (US) 33308-2303

( * ) Notice: Subject to any disclaimer, the term of this patent is extended or adjusted under 35 U.S.C. 154(b) by 0 days.

(21) Appl. No.: 09/390,577

(22) Filed: Sep. 3, 1999

(51) Int. Cl.[7] ..... F21V 9/00

(52) U.S. Cl. ..... 362/276; 362/84; 362/280; 362/367; 40/463; 40/564; 40/714; 40/716

(58) Field of Search ..... 362/276, 84, 228, 362/229, 812, 240, 125, 241, 367, 802; 40/71, 716, 768, 564, 571, 463, 455, 454

(56) References Cited

U.S. PATENT DOCUMENTS

| | | | | | |
|---|---|---|---|---|---|
| 4,975,809 | A | * | 12/1990 | Ku | 362/31 |
| 4,982,176 | A | * | 1/1991 | Schwarz | 340/567 |
| 5,265,357 | A | * | 11/1993 | Yu | 40/152.2 |
| 5,664,352 | A | * | 9/1997 | Beckman | 40/545 |
| 5,787,618 | A | * | 8/1998 | Mullis | 40/219 |

OTHER PUBLICATIONS

Lites Online Picture and Cabinet Lights, http://www.liteson-line.com/Picture.html pp. 1 and 2 Aug. 29, 1999.

New World LIghting, Inc., http://www.picturelitee.com/wel-come.html Aug. 29, 1999.

Cordless Fluorescent Picture Light http://www.theframery-.com/cordlessfluorescentpicture.htm pp. 1 Aug. 29, 1999.

Picture Light Printable Catalog http://www.theframery.com/picturelitecat.htm pp 1–3 Aug. 29, 1999.

Concept Cordless Picture Lights–1 http://users.erols.com/koncept/concept–home.htm 5 pages Aug. 29, 1999.

* cited by examiner

*Primary Examiner*—Sandra O'Shea
*Assistant Examiner*—Bertrand Zeade
(74) *Attorney, Agent, or Firm*—Oltman, Flynn & Kubler

(57) ABSTRACT

A display apparatus for an art work includes a work support structure on which the art work rests; a power source; and an electric power circuit containing a light source oriented toward the work and a switch wired to a sensor for detecting the approach of a person, and upon detection to close the switch and thereby activate the light source to illuminate the work. The light source preferably is a low heat, substantially full visible spectrum light source. The light source preferably includes a fluorescent bulb and a reflector adjacent to the fluorescent bulb, the reflector being oriented relative to the fluorescent bulb to direct light from the fluorescent bulb toward the art work. The apparatus preferably additionally includes a timer, where the sensor is connected to the timer to shut off the switch a pre-set length of time after the moment of the last detected motion or body heat.

17 Claims, 5 Drawing Sheets

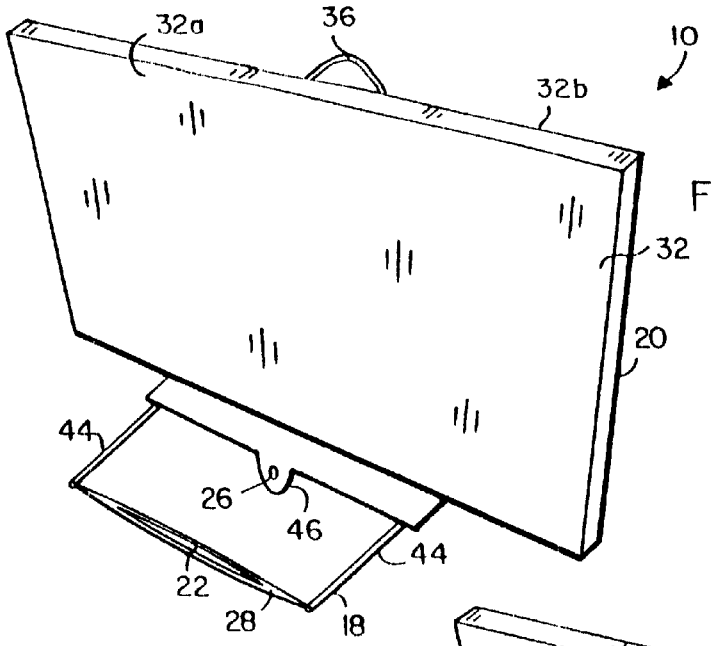
FIG. 1
FIG. 2
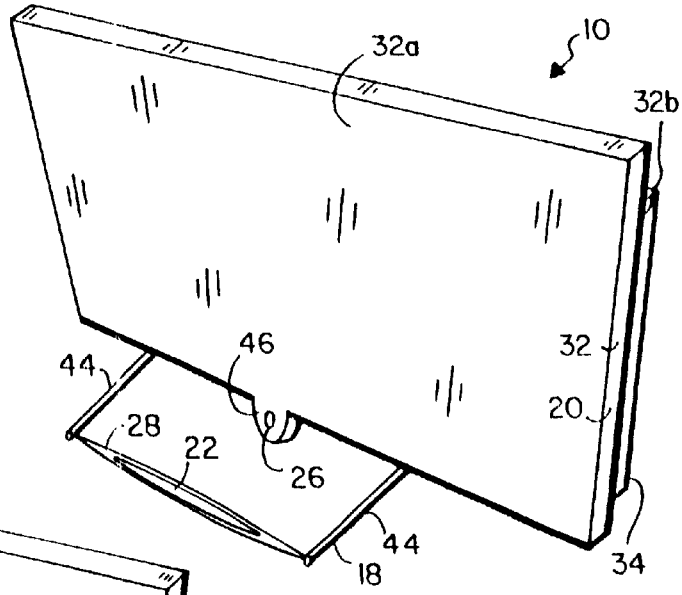
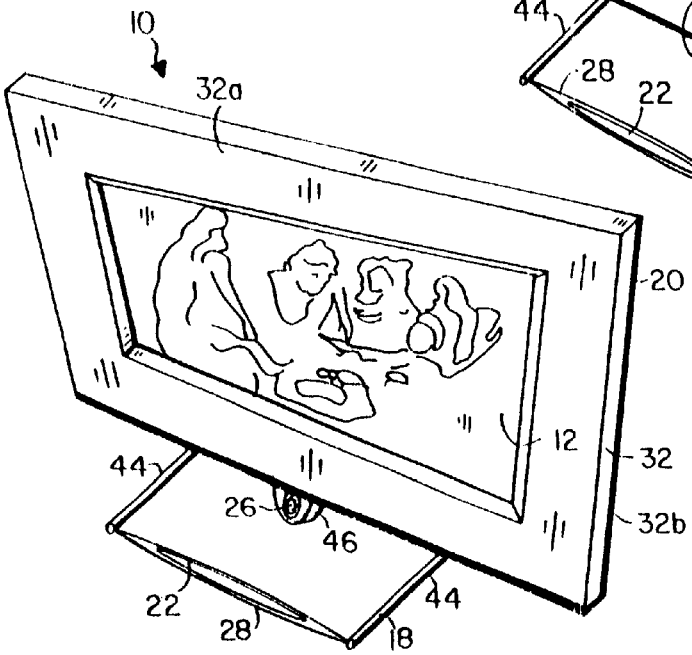
FIG. 3

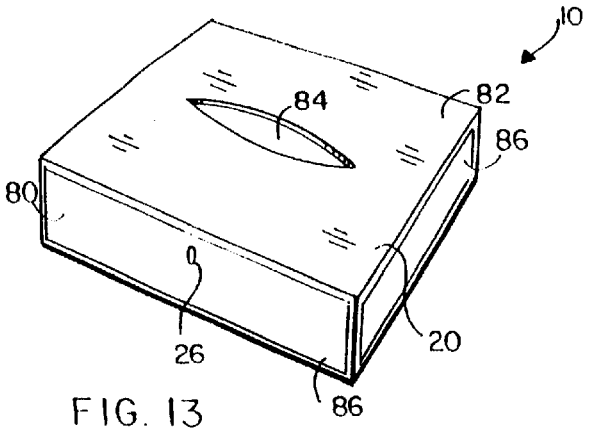
FIG. 13
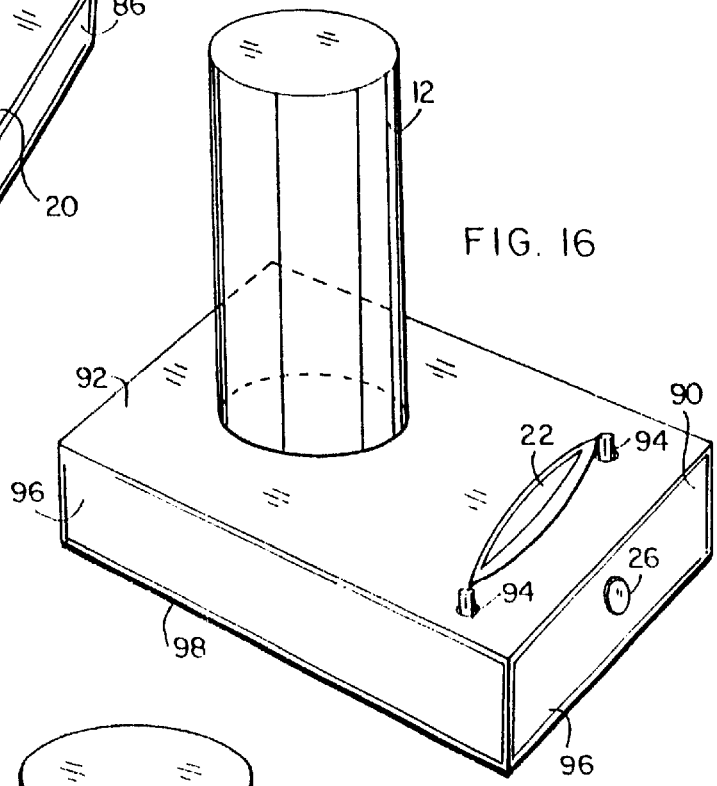
FIG. 16
FIG. 14
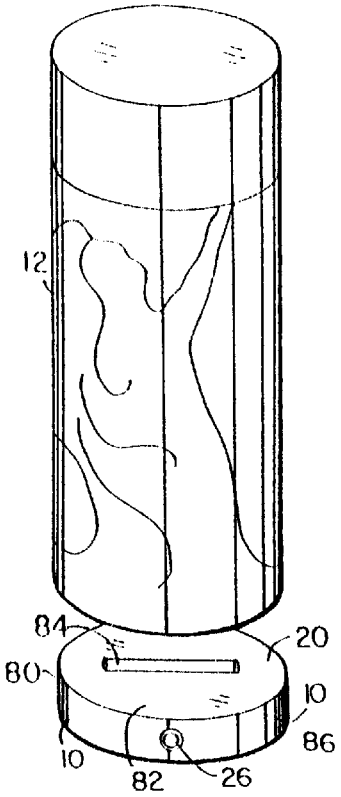
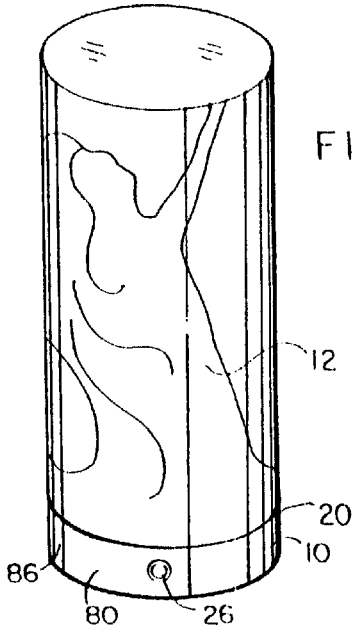
FIG. 15

DISPLAY APPARATUS FOR WORKS OF ART

BACKGROUND OF THE INVENTION

1. Field of the Invention

The present invention relates generally to the field of display means for works of pure and commercial art. More specifically the present invention relates to a display apparatus for art works including a work support structure and an electric power circuit containing a low heat, full spectrum light source, oriented toward the work and a switch wired to a motion sensor oriented to detect the approach of a person, and upon detection to close the switch and thereby activate the light source to illuminate a work resting on the support structure.

For paintings, the work support structure includes a backboard having a forward face against which the painting is placed and a rearward face against which several flat lead batteries are removably mounted with conventional fasteners. For photographs, the work support structure includes housing, the upper portion of which is a generally rectangular translucent panel bent at its middle region into an inverted V-shape to present two opposing photograph mounting surfaces. The translucent panel fits onto a housing lower portion having generally triangular end walls sized and shaped to fit snugly across the interior of the translucent panel V-shape, and having front and rear walls shorter than the side walls so that the translucent panel completes and closes the front and rear of the housing, and having a removable bottom wall. The photographic images are inventively provided with high pigment intensity and selected brightened areas, for illuminated display. A painting print and photograph displaying embodiment is provided which displays a print or photographic image on only one, forward face. For this embodiment, the work support structure includes picture frame having a generally dish-shaped backpanel having at its center the light source as described above oriented to cast light forwardly through the photograph. For glass sculpture and specifically for crystal sculpture and for such as the commercial art found in high quality perfume bottles, the work support structure includes a cylindrical hollow pedestal containing the power circuit, with the light source oriented to cast light upwardly and with the motion sensor mounted in an opening in the front of the pedestal. The pedestal has a horizontal top wall with an upper wall on which the art work is placed, and the upper wall includes a diametrically elongate light passing opening.

2. Description of the Prior Art

There have long been easels and wall mounted frames adjacent to incandescent light sources receiving power from electric cords plugging into wall sockets, for displaying and illuminating art works. Examples of prior art work lighting products are PICTURE LIGHTS™ and PICTURE-LITE™ of New World Lighting, Inc. A problem with these display means has been that the cords supplying power to the light sources are unsightly and detract from the atmosphere created at an art exhibition. Yet since power is needed to light the art works continuously throughout the day, the use of battery power sources is impractical because they would so frequently require replacing. Another problem is that the continuous illumination, in a sense, causes the art works to become part of the background and draw less notice.

Photographs having artistic content can be difficult to see well if displayed in a conventional frame, and present the same unsightly power cord problems identified above for paintings. By the same token, the subtleties in color and shape of glass sculpture and ornate glass product containers can be lost when they are simply placed on display pedestals, even when light is directed at them.

It is thus an object of the present invention to provide an apparatus for mounting and displaying works of art, including an electric power circuit and light source oriented to cast light onto or through the art work, the light source being fluorescent and of very small diameter to illuminate quickly and converting a larger than average percentage of power supplied to it to light rather than heat, and thus emitting minimal heat while casting very bright light.

It is another object of the present invention to provide such an apparatus which includes a motion or heat sensor and switch combination in the power circuit to detect the approach of a potential viewer and thereupon close the switch to deliver power to the light source and illuminate the art work as the person approaches.

It is a still further object of the present invention to provide such an apparatus which prevents the typical loss of interest in a glass sculpture occurring when the purchaser takes the work from a shop in which it was well illuminated to his or her home in which there is only minimal illumination.

It is still another object of the present invention to provide such an apparatus which includes a timer within the motion sensor and switch combination to open the switch after a pre-set length of time following the last detected movement, so that electric power is conserved to make batteries a practical power source and so that the attention of a potential viewer is drawn to the art work as he or she approaches the apparatus and work. This object in practical terms requires use of the rapid illumination light source mentioned in one of the previous objects, because a conventionally wide fluorescent bulb might not light at all before the timer duration elapsed and turned off power to the bulb.

It is a still further object of the present invention to provide such an apparatus which can illuminate photographs and prints of paintings with full pigment intensity, avoiding a color washout, and which can also radiate greater light intensity at selected locations on the photographs, such as where one would expect bright areas in the photograph images.

It is finally an object of the present invention to provide such an apparatus which is relatively inexpensive to manufacture and is attractive in appearance.

SUMMARY OF THE INVENTION

The present invention accomplishes the above-stated objectives, as well as others, as may be determined by a fair reading and interpretation of the entire specification.

A display apparatus is provided for an art work, including a work support structure on which the art work rests; a power source; and an electric power circuit containing a light source oriented toward the work and a switch wired to a motion sensor for detecting the approach of a person, and upon detection to close the switch and thereby activate the light source to illuminate the work.

The light source preferably is a low heat, substantially full visible spectrum light source. The light source preferably includes a fluorescent bulb and a reflector adjacent to the fluorescent bulb, the reflector being oriented relative to the fluorescent bulb to direct light from the fluorescent bulb toward the art work. The apparatus preferably additionally includes a timer, where the motion sensor is connected to the timer to shut off the switch a pre-set length of time after the moment of the last detected motion.

Where the art work is a painting, the work support structure preferably includes a backboard having a forward face against which the painting is placed and having a rearward face; and the power source includes a battery adjacent to the rearward face; and the circuit includes wiring extending from the battery to a pair of spaced apart conductive lead rods protruding forwardly beneath and perpendicular to the backboard, the having lead rod forward ends being interconnected by the light source, the light source being oriented to cast light toward the backboard forward face. The backboard has a lower end and the apparatus preferably additionally includes a protrusion at the backboard lower end having a protrusion port containing the motion sensor, the protrusion being notched to engage and support the painting lower edge.

Where the art work is at least one photograph, the work support structure preferably includes a housing having a housing upper portion including a substantially rectangular translucent panel bent at its middle region into an inverted V-shape to present two opposing photograph mounting surfaces; a housing lower portion onto which the translucent panel fits, the housing lower portion having substantially triangular end walls sized and shaped to fit across the interior of the folded the translucent panel, and having front and rear walls shorter than the end walls so that the translucent panel completes and substantially closes the housing, and having a removable bottom wall; where the light source is oriented to cast light upwardly into the folded the translucent panel and out through the translucent panel and through any photograph mounted against the translucent panel. The translucent panel preferably is formed of a clear acrylic. The power source preferably is a battery pack resting on top of the bottom wall, and the power circuit preferably includes wires extending from the battery pack to the light source and to the motion sensor, the timer and the switch. The motion sensor preferably is fit into a port within the housing front wall, surrounded by a photograph supporting protrusion.

The composite image photograph preferably includes a sheet having sheet forward and rearward faces and having corresponding mirror images printed on both of the forward and rearward faces for enhanced pigment intensity when illuminated. The photographic images include areas of reduced or increased pigmentation to permit more or less light, respectively, from the light source to pass through these areas. Alternatively, the composite image photograph may be a conventional photograph with an image on its forward face and a transparent film sheet placed behind the photograph having a reversed image aligned with the photograph image to produce the composite image when light is shined through the photograph and film.

Where art work is a photograph or a print of a painting the work support structure preferably includes a picture frame containing a frosted acrylic mounting panel for containing the art work and a substantially dish-shaped backpanel removably secured to the backboard, the backboard having the light source secured its center and oriented to cast light forwardly through the picture frame and through the work. The apparatus preferably additionally includes a backpanel propping stand secured to the backpanel for propping the backpanel upright on a table. The backpanel preferably has a battery recess and the power circuit preferably includes circuit wiring extending from the light source through the backpanel into the battery recess, and the power source is at least one battery secured within the battery recess.

Where the art work is a glass sculpture, the work support structure preferably includes a hollow pedestal containing the power circuit and the light source, the pedestal having a pedestal side wall and a pedestal top wall with a light passing opening, the light source being oriented to cast light upwardly through the light passing opening; the motion sensor being fitted through a motion sensor opening in the pedestal; so that activation of the light source by the motion sensor causes light to pass through the light passing opening into the art work resting on the top wall, and the light is defracted and scattered throughout the interior of the art work, illuminating and highlighting any corners, irregularities in configuration and tinting in the art work. The light passing opening is preferably elongate. The pedestal preferably includes a pedestal bottom wall which is removably fitted to the pedestal side wall for access to the light source and the power source. The power source preferably includes a wall outlet, a power cord extending from the wall outlet and a transformer between the wall outlet and power cord. The motion sensor, the switch, and the timer are optionally combined as a single unit.

A method of illuminating an art work is provided using the above described apparatus, including the steps of detecting the approach of a person with the sensor; activating the light source by operating the switch upon detecting the approach of a person to shine on the art work; and deactivating the light source by operating the switch with said timer after a certain length of time has passed following detection of a person approaching.

BRIEF DESCRIPTION OF THE DRAWINGS

Various other objects, advantages, and features of the invention will become apparent to those skilled in the art from the following discussion taken in conjunction with the following drawings, in which:

FIG. 1 is a perspective view of the first preferred embodiment of the art display apparatus, specifically for paintings.

FIG. 2 is another perspective view of the apparatus of FIG. 1.

FIG. 3 is a perspective view of the apparatus of FIG. 1 with a painting mounted on the apparatus.

FIG. 13 is a perspective view of the apparatus of FIG. 12 assembled. The housing happens to be square in this illustration, but it can also be round as shown in FIGS. 14–15.

FIG. 14 is a view of the apparatus of FIG. 12 with a glass sculpture poised above the apparatus for placement on the apparatus top wall for display.

FIG. 15 is a view as in FIG. 14 with the glass sculpture shown lowered onto the apparatus top wall, ready for lighting and display.

FIG. 16 is a perspective view of the fifth preferred embodiment of the apparatus, specifically for opaque sculpture, showing the light source and removable bottom wall.

DETAILED DESCRIPTION OF THE PREFERRED EMBODIMENTS

Figure 4:
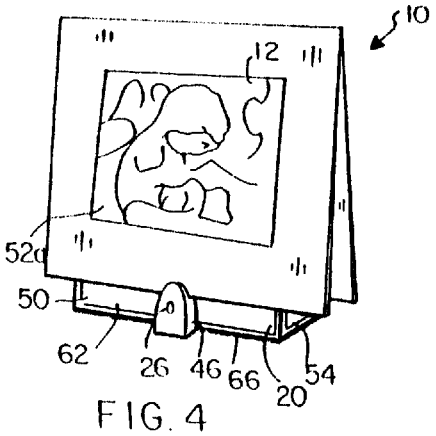
FIG. 4 is a perspective view of the apparatus of the second embodiment, specifically for photographs, assembled and having a photograph mounted on one of its display faces.
Figure 5:
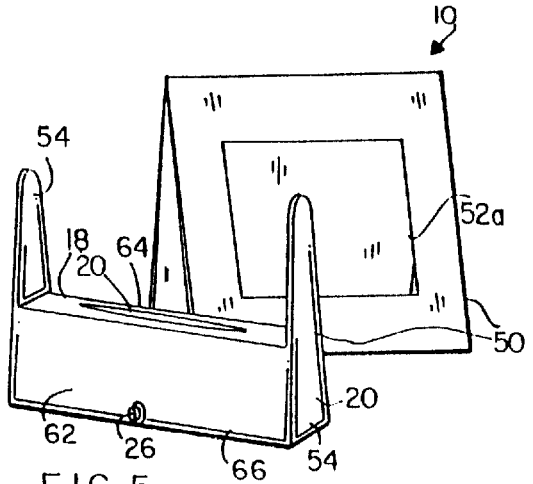
FIG. 5 is perspective view of the apparatus of FIG. 4 with the photograph removed and the housing upper portion separated from the housing lower portion.
Figure 6:
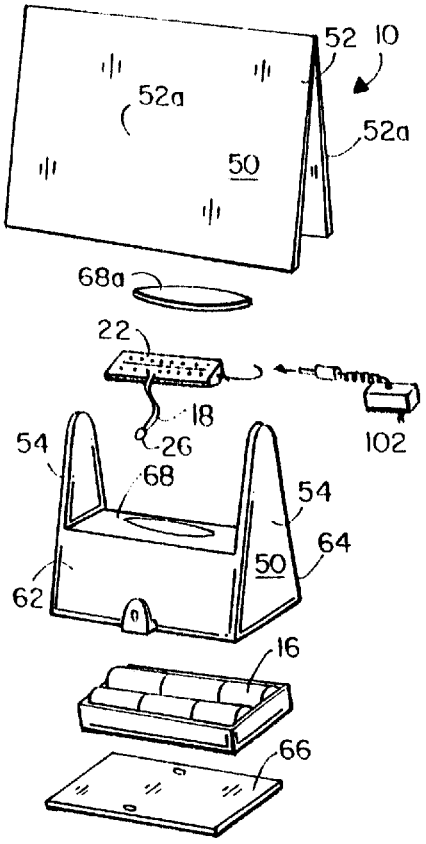
FIG. 6 is an exploded view of the apparatus of FIG. 4, showing the light source, motion sensor and battery pack, and removably bottom wall.
Figure 7:
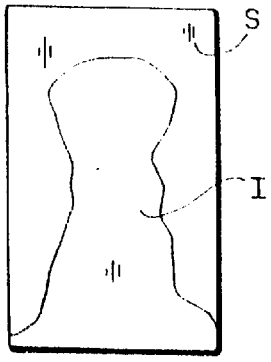
FIG. 7 is a front view of the inventive photograph, showing one of the two images.
Figure 8:
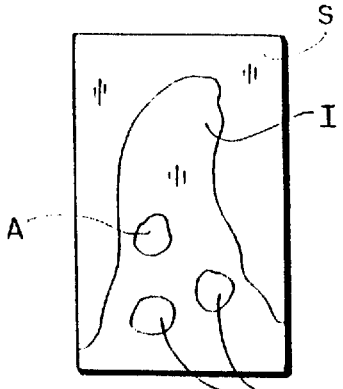
FIG. 8 is a rear view of the inventive photograph, showing the second image forming the composite image, the second image having the selected areas of pigment removed to brighten those areas in the composite image as light shines through the composite image.
Figure 9:
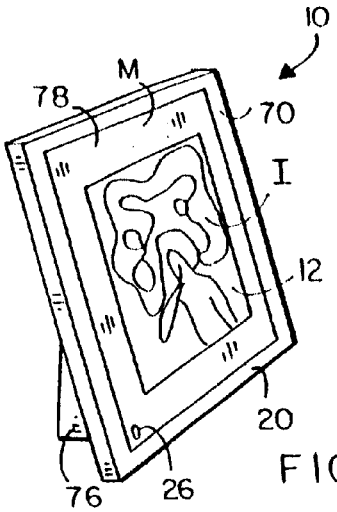
FIG. 9 is a perspective view of the third embodiment of the apparatus, once again specifically for photographs, assembled and having a photograph mounted in its frame portion for display.
Figure 10:
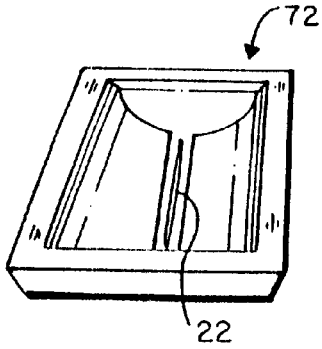
FIG. 10 is a perspective front view of the frame backpanel for the apparatus of FIG. 9, showing the dish shape and light source.
Figure 11:
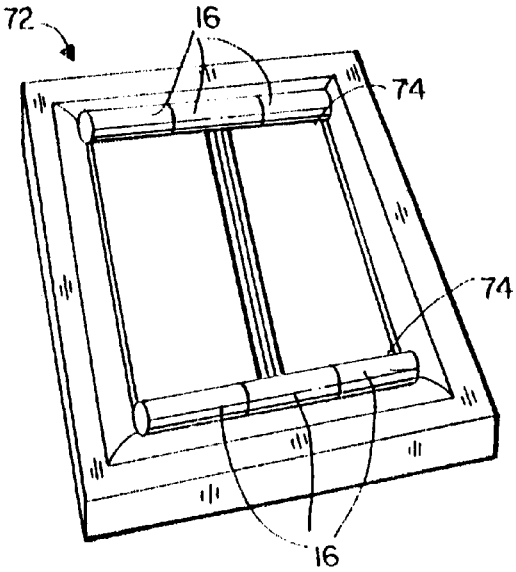
FIG. 11 is a perspective view of the backpanel of FIG. 10 showing the battery recesses, each recess shown containing three "C" batteries.
Figure 12:
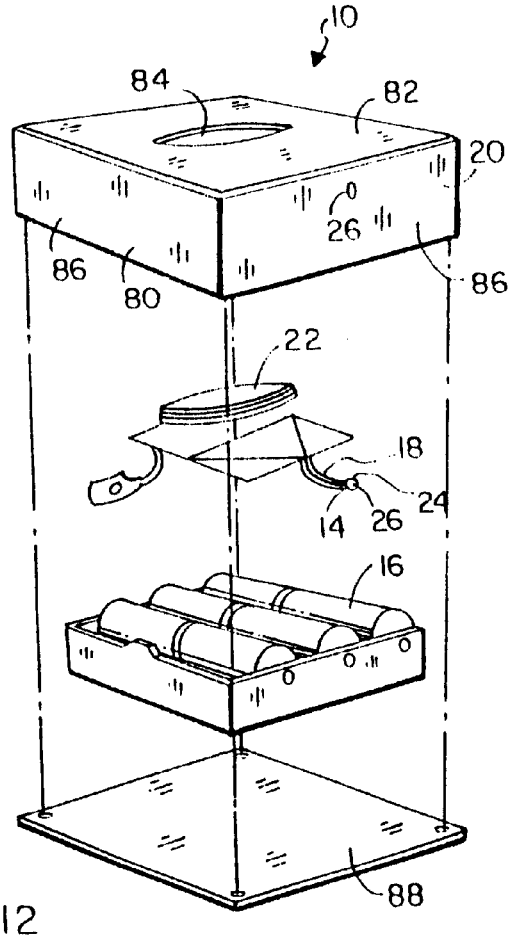
FIG. 12 is an exploded view of the fourth preferred embodiment of the apparatus, specifically for glass sculpture such as high end perfume bottles, showing the light source, battery pack and motion sensor, and removable bottom wall.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 17:
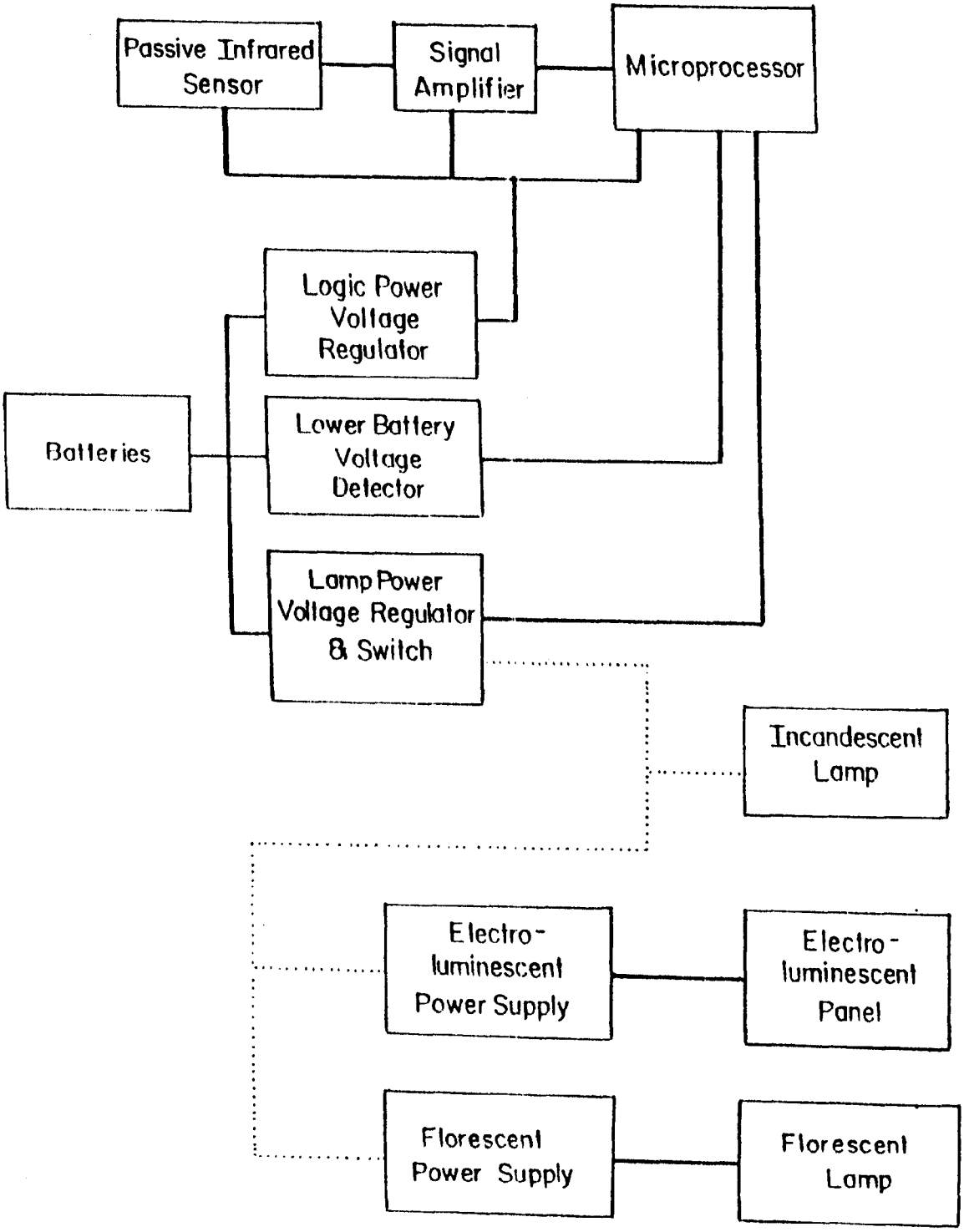
FIG. 17 is a block diagram of the functional elements of the apparatus generally for all embodiments.

Referring to FIGS. 1–17, a display apparatus 10 is disclosed for art works 12 including a work support structure 20, a power source 16 and an electric power circuit 18 containing a low heat, full spectrum light source 22, oriented toward the work 12 and a switch 24 wired to a sensor 26 which is preferably a conventional motion sensor oriented to detect the approach of a person, and upon detection of motion or heat to close the switch 24 and thereby activate the light source 22 to illuminate a work 12 resting on the support structure 20. Sensor 26 may be a passive infrared sensor for detecting the presence of a person or an animal within close proximity to the device. The device detects body heat on two identical sensor plates within the device and monitors the difference between the heat reaching the two plates. The term "sensor" is used below to indicate either a motion or heat sensor. Sensor 26 and contains a timer 14 set to keep switch 24 closed for a duration of several seconds, preferably 15 to 20 seconds, from the last detected movement. Sensor 26 and switch 24 are preferably contained within a single computer chip. Several embodiments of the work support structure 20 are provided, corresponding to the type of work 12 to be displayed. A block diagram is provided in FIG. 17 to show the elements of these embodiments generally, and these elements are explained more fully at the end of this detailed description. The preferred light source 22, common to all embodiments, is either part number P/N WL-CFL14115 or P/N WL-CFL14070, by WAMCO, INC™, narrow diameter fluorescent bulbs which are mounted over a reflector plate covered by a strip of reflective tape, preferably of the kind made by 3-M™. Several bulbs may be used to illuminate larger works 12, and the bulbs are preferably low energy bulbs. The power source 16 may be a battery pack or individual batteries, or may be a power cord plugged into a conventional wall outlet and a transformer between the wall outlet and the power cord. For this version the timer duration is preferably set for 60 seconds to one hour. Where power source 16 is a battery, the preferred timer duration is several seconds to conserve power and extend the life of the battery. Where power source 16 is a power cord the preferred timer duration is one hour, although many other time durations are contemplated. For paintings, the work support structure 20 includes a backboard 32 having a forward face 32*a* against which the painting 12 is placed and a rearward face 32*b* against which several flat lead batteries 34 are removably mounted with conventional fasteners (not shown). See FIGS. 1–3. Backboard 32 is either hung on a wall hanger 36 or supplied with a propping flange and stood up on a table. Power circuit 18 includes wiring extending from the batteries 16 and a pair of spaced apart conductive lead rods 44 connected to the battery wiring and protruding forwardly beneath and perpendicular to backboard 32. The lead rod 44 forward ends are interconnected by the fluorescent light source 22 and reflector 28 which is oriented to cast light toward the backboard forward face 32*a* and mounted painting 12. The lead rods 44 are preferably telescoping rods so that the distance of light source 22 from the art work 12 can be adjusted for art works 12 of various sizes. The sensor 26 and switch 24 combination preferably are mounted within a triangular protrusion 46 at the backboard 32 lower edge, the protrusion 46 being notched to engage and support the painting 12 lower edge. This protrusion 46 is preferably notched to catch and support the painting 12 lower edge. As a person approaches apparatus 10 the sensor 26 activates the switch 24 to close the power circuit 18 and cast light on the painting 12.

Second Preferred Embodiment

For photographs, the work support structure 20 includes a housing 50, the upper portion of which is a generally rectangular translucent panel 52 bent at its middle region into an inverted V-shape to present two opposing photograph mounting surfaces 52*a*. See FIGS. 4–6. The translucent panel 52 is preferably formed of frosted acrylic. Translucent panel 52 fits onto a housing 50 lower portion having generally triangular end walls 54 sized and shaped to fit snugly across the interior of the translucent panel 52 V-shape, and having front and rear walls 62 and 64, respectively, shorter than end walls 54 so that translucent panel 52 completes and closes the front and rear of housing 50, and having a removable bottom wall 66 and a top wall 68 with a wall port fitted with a removable clear acrylic insert 68*a* which is optionally tinted. A power source 16 is a battery pack resting on top of bottom wall 66, and power circuit 18 wires extend from the battery pack to the light source 22 and the sensor 26, timer 14 and switch 24 combination. Light source 22 is as described above and is retained within housing 50, oriented upwardly to direct light into translucent panel 52 and out through the mounting surfaces 52*a*. Sensor 26 is preferably fit into a port within housing front wall 62, surrounded by a decorative triangular photograph supporting protrusion 46. Should the user prefer not to have the work 12 illuminated each time someone approaches, he or she can simply mount the work 12 on the rearward facing mounting surface 52*a* and turn apparatus 10 around so that the sensor 26 faces a building wall.

Photographs 12 are inventively provided with high pigment intensity and selected brightened areas A, for illuminated display. See FIGS. 7–8. Photographs 12 are composite digital images I, and one is printed on a photograph sheet S outward face and the other is matchingly reversed and aligned printed on the sheet S inward face so that light from the light source 22 passes through both, doubling the pigment intensity to look like the original work. Selected areas A of the image on the sheet S inward face are omitted or lightened, so that more light passes through these areas, giving them greater brightness than surrounding areas of the composite image I. Alternatively, pigmentation in selected areas A is increased relative to the rest of the image, so that less light light passes through areas A, for darkening areas of a the composite image I which one would expect to appear darker. This selective brightening can create a dramatic effect by brightening candle and sunlight representations in the composite image I. Alternatively, the composite image I photograph may be a conventional photograph with an image on its forward face and a transparent film sheet placed behind the photograph having a reversed image aligned with the photograph image to produce the composite image when light is shined through the photograph and film.

Third Preferred Embodiment

A painting print and photograph 12 displaying embodiment is provided which displays a photographic image I on only one, forward face. See FIGS. 9–11. For this embodiment, the work support structure 20 includes picture frame 70 containing a frosted acrylic mounting panel 78. Panel 78 is optionally tinted. Against the mounting panel 78 is placed a border matt M, and matt M can be of any color or design desired for aesthetic matching with the print or photograph 12. The frame 70 is fitted with a generally dish-shaped backpanel 72 having at its center the light source 22 as described above oriented to cast light forwardly through the photograph 12. Power circuit wiring 18 extends from the light source 22 through backpanel 72 into battery recesses 74 to battery terminals (not shown) between which D batteries are mounted. An upright battery recess 74 is preferably along each side of the rear face of backpanel 72. Backpanel 72 includes a propping flange 76 extending from the back.

Fourth Preferred Embodiment

For glass sculpture 12 such as the commercial art found in high quality perfume bottles, the work support structure 20 includes a cylindrical hollow pedestal 80 containing power circuit 18, with light source 22 oriented to cast light upwardly and with sensor 26 mounted in an opening in the front of pedestal 80. See FIGS. 12–15. Pedestal 80 has a horizontal top wall 82 with an upper surface on which the work 12 is placed, and the top wall 82 includes a diametrically elongate light passing opening 84. Pedestal 80 also has a tubular side wall 86 and a removable bottom wall 88 on which power source 16 in the form of a battery pack rests. Activation of the light source 22 by the sensor 26 causes light to pass through light passing opening 84 into the bottom of a glass sculpture art work 12 resting on top wall 82, and the light is defracted and scattered throughout the interior of the work 12. Such illumination highlights corners, irregularities in configuration and tinting to fully reveal the details of the work 12, which appears to glow from within.

Fifth Preferred Embodiment

For an opaque sculpture 12, the work support structure 20 includes a cylindrical hollow pedestal 90 containing power circuit 18, with sensor 26 mounted in an opening in the front of pedestal 90. See FIG. 16. Pedestal 90 has a horizontal top wall 92 with an upper surface on which the work 12 is placed. Light source 22 is of the type generally described above including the reflector and is pivotally mounted between brackets 94 extending upwardly from one end of the upper surface of top wall 92 and oriented to cast light toward the work 12. Pedestal 90 also has a tubular side wall 96 and a removable bottom wall 98 on which power source 16 in the form of a battery pack rests. Activation of the light source 22 by the sensor 26 causes light to radiate from light source 22 toward work 12. Such illumination highlights corners and irregularities in configuration to fully reveal the details of the work 12.

As mentioned above, FIG. 17 shows a block diagram of the preferred circuit and elements. These include the passive infrared sensor, described in the paragraphs above.

Also included is a signal amplifier. The signal from the passive infrared sensor is very small. The signal is amplified by a two-stage signal amplifier so that it is large enough to be used by the remaining parts of the assembly. Each amplifier has a gain of ×100 for a total for a total amplification factor of 10,000. The signal between these two amplifier stages is AC coupled and referenced to half the battery voltage.

A microprocessor is included. Control of the circuit is provided by an on-board microprocessor. This microprocessor executes instructions that have been preprogrammed into its internal memory. Each of the features of the assembly is programmed into this microprocessor. The microprocessor performs the following tasks: (1) monitoring the amplified sensor signal for activity; (2) turning the lamp ON or OFF at the proper time; (3) monitoring the battery voltage for a "low battery" condition; and (4) signals the user of the "low battery" condition.

The microprocessor monitors the amplified sensor signal to determine if the signal has varied enough from a non-active level to be classified as having reached an active level. The active level is defined as the level present when a person or animal is moving in front of the sensor. This microprocessor's algorithm incorporates a dead band into the level detector permitting the amplified signal to move to some degree before an active state is declared.

The circuit also includes the period timer 14. Once an active state has been determined, the microprocessor starts the period timer. If further movement of the person or animal occurs during the active period, the microprocessor resets the time for another period. The time period can be programmed from a minimum 1 second to 60 days, in the present case from 1 to 60 seconds when the power is coming from batteries and 1 to 8 hours when the power is coming from a wall transformer 102.

A logic voltage regulator is included in the circuit 18. Power for the logic portion of the apparatus 10 is supplied by the logic power voltage regulator. This 5 VDC regulator supplies power to the sensor, the time, and all other parts of the circuit 18 ex except for the lamp power.

Further provided in circuit 18 is a lamp power regulator and the switch. The apparatus is equipped with a high-efficiency switching regulator power supply circuit that converts incoming power from the unit's batteries or an optional wall transformer to a regulated power for the light source 22. The power regulator is equipped with a switch that places the regulator into a low-power standby mode when the microprocessor has turned off the light source 22.

The light source 22 is described in some detail in the paragraphs above. It is equipped with one of several types of lamps which are switched ON and OFF as described above. These lamps may be incandescent, florescent, or electroluminescent. One of more incandescent bulbs located on the apparatus 10 may be directly driven from the lamp power voltage regulator. The florescent lamp and the electroluminescent lamp each require an additional stage of power supply to generate the required voltage and frequency.

The entire apparatus 10 is powered by standard "D" alkaline batteries. Alternate power sources are rechargeable batteries or a wall mounted transformer.

The circuit 18 is equipped with a low-battery-voltage detector circuit. The voltage detector circuit is set to detect when the batteries are substantially depleted. The microprocessor monitors the battery voltage and compares this voltage with that of the fully depleted battery voltage. When the low voltage condition occurs, this microprocessor causes the lamp to flash ON and OFF at an approximate 1 hertz rate. The flashing occurs occasionally when the low voltage condition starts. As the battery voltage gets lower, the flashing occurs continuously until the batteries are completely depleted.

While the invention has been described, disclosed, illustrated and shown in various terms or certain embodiments or modifications which it has assumed in practice, the scope of the invention is not intended to be nor should it be deemed to be, limited thereby and such other modifications or embodiments as may be suggested by the teachings herein are particularly reserved especially as they fall within the breadth and scope of the claims here appended.

We claim:

1. A display apparatus for an art work, comprising:

a work support structure on which the art work rests;

a power source;

and an electric power circuit containing a light source and a switch wired to a sensor for detecting the approach of a person, and upon detection to close said switch and thereby activate said light source to illuminate the work;

wherein said work support structure comprises a backboard said backboard having a forward face and a rearward face wherein said art work rests on said forward face of said backboard;

wherein said power source comprises a battery;

and wherein said circuit comprises conduction means extending from said battery to a pair of spaced apart conductive lead rods protruding forwardly beneath said backboard to a location forward of said backboard, said lead rods having lead rod forward ends which are interconnected by said light source, said light source being oriented to cast light rearwardly toward the artwork.

2. A display apparatus for an art work, comprising:

a work support structure on which the art work rests;

a power source;

and an electric power circuit containing a light source and a switch wired to a sensor for detecting the approach of a person, and upon detection to close said switch and thereby activate said light source to illuminate the work;

wherein said work support structure comprises a backboard said backboard having a forward face and a rearward face wherein said art work rests on said forward face of said backboard;

wherein said power source comprises a battery;

wherein said circuit comprises conduction means extending from said battery to a pair of spaced apart conductive lead rods protruding forwardly beneath said backboard, said lead rods having lead rod forward ends which are interconnected by said light source, said light source being oriented to cast light toward the artwork;

and wherein said backboard has a lower end, additionally comprising a protrusion at the backboard lower end containing a protrusion port containing said sensor, said protrusion being notched to engage and support the painting lower edge.

3. A display apparatus for an art work, comprising:

a work:support structure on which the art work rests;

a power source;

and an electric power circuit containing a light source and a switch wired to a sensor for detecting the approach of a person, and upon detection to close said switch and thereby activate said light source to illuminate the work;

wherein the art work is at least one photograph, and wherein said work support structure comprises a housing having a housing upper portion including a substantially rectangular translucent panel bent at its middle region into an inverted V-shape to present two opposing photograph mounting surfaces; a housing lower portion onto which said translucent panel fits, said housing lower portion having substantially triangular end walls sized and shaped to fit across the interior of said bent translucent panel, and having front and rear walls shorter than said end walls such that said translucent panel completes and substantially closes said housing, and having a removable bottom wall;

and wherein said light source is oriented to cast light upwardly into said bent translucent panel and out through said translucent panel and through any photograph mounted against said translucent panel.

4. The apparatus of claim 3, wherein said translucent panel is formed of a frosted acrylic.

5. The apparatus of claim 3, wherein said power source is a battery pack resting on top of said bottom wall, and said power circuit comprises wires extending from said battery pack to said light source and to said sensor, said timer and said switch.

6. The apparatus of claim 3, wherein said sensor is fit into a port within said housing front wall, surrounded by a photograph supporting protrusion.

7. The apparatus of claim 3, wherein said photograph comprises a sheet having sheet forward and rearward faces and having corresponding mirror images printed on both of said forward and rearward faces for enhanced pigment intensity when illuminated.

8. The apparatus of claim 3, wherein said photographic images comprise areas of reduced pigmentation to permit more light from said light source to pass through said areas.

9. The apparatus of claim 3, wherein said photographic images comprise areas of increased pigmentation to permit less light from said light source to pass through said areas.

10. The apparatus of claim 1, wherein said art work is a photograph and wherein said work support structure comprises:

a picture frame for containing said art work and a substantially dish-shaped backpanel removably secured to said backboard, said backboard having said light source secured its center and oriented to cast light forwardly through said picture frame and through said work.

11. The apparatus of claim 10, additionally comprising a backpanel stand means secured to said backpanel for propping said backpanel upright on a table.

12. The apparatus of claim 19, wherein said backpanel has a battery recess and wherein said power circuit comprises circuit wiring extending from said light source through said backpanel into said battery recess, and wherein said power source is at least one battery secured within said battery recess.

13. A display apparatus, comprising:

a power source;

and an electric power circuit containing a light source and a switch wired to a sensor for detecting the approach of a person, and upon detection to close said switch and thereby activate said light source;

an art work support structure comprising a hollow pedestal containing said power circuit and said light source, said pedestal having a pedestal side wall and a pedestal top wall with a light passing opening, said light source being oriented to cast light upwardly through said light passing opening;

wherein said sensor is fitted through a sensor opening in said pedestal;

and an art work resting on top of said pedestal top wall and over said light passing opening;

such that activation of said light source by said sensor causes light to pass through said light passing opening into the art work resting on said top wall, and the light is defracted and scattered throughout the interior of the art work, illuminating and highlighting any corners, irregularities in configuration and tinting in the art work.

14. The apparatus of claim 13, wherein said light passing opening is elongate.

15. The apparatus of claim 13, wherein said pedestal comprises a pedestal bottom wall which is removably fitted to said pedestal side wall for access to said light source and said power source.

16. The apparatus of claim 1, wherein said power source comprises a wall outlet, a power cord extending from said wall outlet and a transformer between said wall outlet and power cord.

17. A display apparatus, comprising:

a power source;

and an electric power circuit containing a light source and a switch wired to a sensor for detecting the approach of a person, and upon detection to close said switch and thereby activate said light source;

an art work support structure comprising a hollow pedestal containing said power circuit and said light source, said pedestal having a pedestal side wall and a pedestal top wall, said light source being mounted to said pedestal and being oriented to cast light upwardly through said light passing opening;

wherein said sensor is fitted through a sensor opening in said pedestal;

and an art work comprising an opaque sculpture resting on top of said pedestal top wall adjacent to said light passing opening;

such that activation of said light source by said sensor causes light to radiate onto the art work resting on said top wall.

* * * * *